US006292431B1

(12) United States Patent
Talamo

(10) Patent No.: US 6,292,431 B1
(45) Date of Patent: Sep. 18, 2001

(54) MARINE SEISMIC CABLE TERMINATION

(76) Inventor: Emil R. Talamo, 19307 Havasu Hills, San Antonio, TX (US) 78256

( * ) Notice: Subject to any disclaimer, the term of this patent is extended or adjusted under 35 U.S.C. 154(b) by 0 days.

(21) Appl. No.: 09/304,805

(22) Filed: May 4, 1999

(51) Int. Cl.[7] ..... H01R 11/00
(52) U.S. Cl. ..... 367/20; 367/122
(58) Field of Search ..... 367/20, 154, 188, 367/122; 439/452, 449, 451, 624, 587; 166/385

(56) References Cited

U.S. PATENT DOCUMENTS 3,833,754 * 9/1974 Philibert ..... 174/65 SS
3,954,154 * 5/1976 Kruppenbach et al. ..... 181/112
4,673,231 * 6/1987 McAnulty ..... 439/587

* cited by examiner

*Primary Examiner*—Hezron Williams
*Assistant Examiner*—Victor J. Taylor
(74) *Attorney, Agent, or Firm*—Alan J. Atkinson

(57) ABSTRACT

A cable termination for connecting cable armor strands to a cable housing end. Individual wire strands are inserted through apertures in an inner hub and are engaged with the inner hub. An outer hub is connected to the inner hub and the housing for selectively tensioning the wire strands. The outer hub can have apertures for engagement with a second set of wire strands, and can be moved relative to the inner hub to selectively balance the tension in the first and second sets of wire strands. The wire strand ends are connected to the hubs at a selected radial distance from the cable center to strengthen the connection, and different structural combinations between the wire strands and the inner and outer hubs can be constructed.

20 Claims, 3 Drawing Sheets

MARINE SEISMIC CABLE TERMINATION

BACKGROUND OF THE INVENTION

The present invention relates to the field of marine seismic exploration. More particularly, the invention relates to an improved cable termination for securing cable ends used in marine seismic operations.

Marine seismic exploration is conducted to investigate the structure and character of subsurface geologic formations underlying a body of water. A seismic vessel tows one or more seismic sources and one or more seismic streamer cables through the water. The seismic sources typically comprise compressed air guns which generate a bubble pulse in the water. The energy from each bubble pulse propagates downwardly into the geologic formations and is reflected at the interfaces between subsurface geological formations and boundaries. The reflected energy is sensed with hydrophones attached to the seismic streamers.

Marine seismic surveys are often conducted with multiple streamers towed behind the seismic vessel. Up to twelve or more streamers can form an array behind the vessel and typically vary in length between three and twelve kilometers. Tail buoys are attached at the end of each streamer for carrying equipment such as radar reflectors, navigation equipment, and acoustic transponders. Hydrophones are attached to each streamer and are typically wired together in receiver groups spaced regularly along each streamer.

The deployment, operation, and retrieval of streamers requires handling and time. Each survey day is expensive and significantly increases survey costs. The streamers are transported to the survey site by the seismic vessel and are deployed into the water after the survey site has been reached. At the end of each survey line, the vessel turns around and charts the next pass. Vessel turns are complicated by the long streamers extending behind the vessel hull, and the towing radius is typically large to minimize the possibility of streamer fouling. When the survey is complete, the streamers are reeled onto the vessel deck for relocation to the next survey site. Deployment, use and retrieval of the streamers generates stress on the streamers and streamer cable connectors.

Cable connectors link individual streamer sections to form extended streamer cables. The cable connectors permit replacement of damaged streamer portions without requiring replacement of the entire streamer length. Marine seismic connectors have a low profile relative to the cable diameter to minimize drag and the corresponding acoustic "noise". The marine seismic connectors typically comprise a metal housing attached to the streamer cable ends and provide for electrical or optical connections for linking the data transmission paths between adjacent streamer sections. A plurality of discrete electrical or optical conductors for transmitting data, signals, and power are surrounded by a multi-strand armor sheath surrounding the conductors to protect such conductors against handling mishaps, shark attacks, contact with underwater obstructions, and other damage causes. The armor sheath also provides the function of providing structural strength to the streamer to prevent over stretching of the elastic streamer conductors.

Various efforts have been attempted to anchor the streamer and armor sheath to marine seismic streamer connectors. The streamer armor is typically attached to the streamer with epoxy adhesives. However, epoxy is relatively brittle and can crack due to fatigue failure. Following such failure, water can intrude within the cracks and damage the enclosed electrical connections. Additionally, epoxy does not effectively resist bending moments acting on the metal anchor strands at the seismic connector attachment. Such bending moments can flex the armor strands, thereby dislodging galvanization on the wire strand exteriors. If the galvanization defoliates from the metal strands, salt water can contact the bare metal strands and cause premature structural failure of the armor strength member.

Epoxy based connections are also limited by other factors. The materials forming epoxy compounds are classified as environmentally hazardous materials subject to reporting and handling restrictions. Additionally, the epoxy compound materials have a limited shelf life which limits the actual epoxy strength and can lead to failure of the epoxy material joint. This feature is particularly limiting for marine seismic operations sailing in remote locations months after the epoxy material is manufactured.

Marine seismic streamers present unique connection problems not found in conventional stranded electrical wires. Numerous cable connections have been developed for anchoring a seismic streamer to a cable termination end. U.S. Pat. No. 3,812,455 to Pearson (1974) disclosed mated seismic streamer couplers. U.S. Pat. No. 4,351,036 to Mollere (1982) disclosed a streamer cable connector link. U.S. Pat. No. 4,530,075 to Pearson (1985) and U.S. Pat. No. 4,526,430 to Williams (1985) each disclosed a seismic cable coupler having a sleeve for transmitting forces across the coupler. U.S. Pat. No. 4,500,980 to Copeland (1985) disclosed a connector assembly for anchoring streamer cables. U.S. Pat. No. 4,953,146 to McMurray (1990) disclosed a housing connected to a streamer. U.S. Pat. No. 4,879,719 to Dumestre (1989) and U.S. Pat. No. 5,214,612 to Olivier et al. (1993) disclosed latching mechanisms for connecting equipment to streamer cables. U.S. Pat. No. 5,513,151 to Morningstar et al (1996) disclosed a streamer coupler having tension member apertures having retaining members passing through the tension member eyes. U.S. Pat. No. 5,510,577 to Corrigan (1996) disclosed an electrical connector assembly having a deformable seal ring.

A need exists for an improved technology for anchoring marine cables such as streamers to connectors. The connection should be easy to implement, should be adjustable, and should withstand the large tensile forces and bending moments present in marine operations.

SUMMARY OF THE INVENTION

The invention provides an apparatus and method for anchoring a cable having armor formed with multiple wire ds. The apparatus comprises a housing and a hub attachable to the housing, wherein said hub has a plurality of contact points for engagement with each wire strand, each contact point engages each wire strand at a selected radial distance from the cable center, and the hub is moveable relative to the housing to selectively tension the wire strands. In other embodiments of the invention, an outer hub is attachable to the housing and to the inner hub for engagement with selected wire strands. The outer hub is moveable relative to the inner hub to modify the tension of the wire strands engaged with the outer hub.

The method of the invention comprises the steps of attaching a housing to the cable, of engaging at least two wire strands with contact points on an inner hub, and of moving the inner hub relative to the housing to modify the tension of the wire strands. In different embodiments, an outer hub can be attached to selected wire strands, and can be moved relative to the housing or to the inner hub to tension the attached wire strands at a different tension than that of the wire strands attached to the inner hub.

DESCRIPTION OF THE PREFERRED EMBODIMENTS

Figure 1:
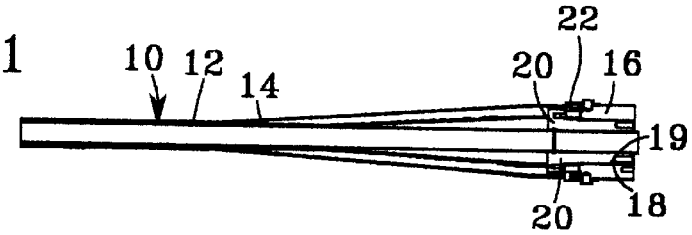
FIG. 1 illustrates an inner hub and outer hub for anchoring armor strands.

The invention provides an improved cable termination for anchoring multi-strand armor cable to a housing. FIG. 1 illustrates a sectional view for one embodiment of the invention engaged with cable 10 having armor 12 formed with individual wire strands 14. Strands 14 can be braided, woven, helically wrapped, or otherwise formed to provide tensile strength, abrasion and impact resistance, and flexibility for cable 10.

Housing 16 is provided as a cable termination for anchoring cable 10 to another cable, equipment, or structure. Housing 16 is illustrated as a cylinder, however other shapes and configurations are possible. Housing 16 has cylindrical theadform 18 for engaging threadform 19 of inner hub 20. Outer hub 22 is engaged with inner hub 20, and can have threadform 24 for engaging inner hub 20 threadform 19. Inner hub 20 and outer hub 22 can be concentric, semi-concentric, or otherwise in operation.

Figure 2:
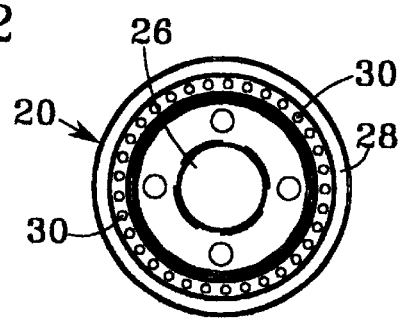
FIGS. 2 and 3 illustrate details for an inner hub.
Figure 3:
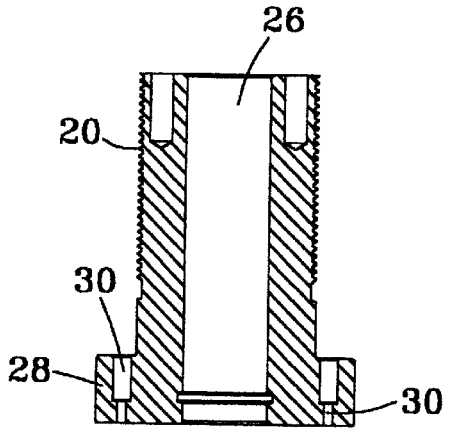

Referring to FIGS. 2 and 3, inner hub 20 includes aperture 26 for permitting insertion of cable 10 components therethrough. Flange 28 extends radially outwardly from aperture 26, and includes a plurality of apertures 30 for permitting insertion of wire strands 14. An end of each wire strand 14 can be inserted through an aperture 30 and can be engaged with inner hub 20 to form a connection therebetween. The connection can be floating or rigid, depending on the connection desired and the ease of attachment. For example, the end of each wire strand 14 can crimped, swaged, or otherwise expanded or modified to anchor wire strands 14 to inner hub 20 while permitting slight relative movement between wire strands 14 and inner hub 20. In other embodiments of the invention, each wire strand 14 can be rigidly attached to inner hub 20 by welding, epoxy, mechanical locking rings, or other types of rigid connection sufficient to establish a contact point for each wire strand 14.

Apertures 30 are preferably located at a radial distance from cable 10 which is greater than the radial distance of wire strands 14 relative to the center of cable 10. By flaring the ends of wire strands 14 radially outwardly, the thickness and bending strength of armor 12 is increased. This feature of the invention significantly increases the connection strength between cable 10 and housing 16. In one embodiment of the invention, outer hub 22 can be integrated within housing 16 so that movement of housing 16 relative to inner hub 20 selectively tensions wire strands 14.

One method of the invention is practiced by engaging the ends of wire strands 14 with inner hub 20, by connecting outer hub 22 to inner hub 20, and by connecting outer hub 22 to housing 16. The tension within wire strands 14 can be adjusted by changing the relative position between inner hub 20 and outer hub 22.

Figure 6:
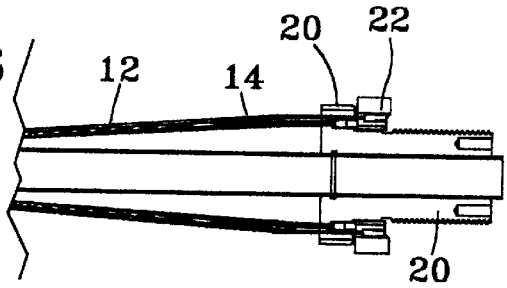
FIG. 6 illustrates wire strands passing through inner hub apertures and terminating at engagement with an outer hub.
Figure 7:
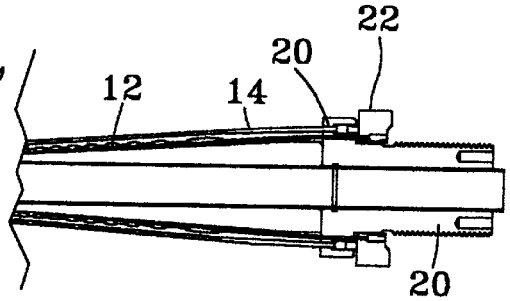
FIG. 7 illustrates a combination of wire strands engaged with both an inner hub and an outer hub.
Figure 4:
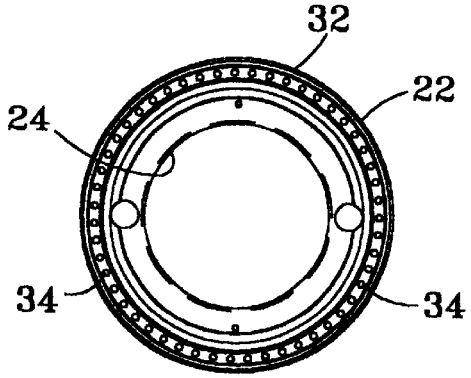
FIGS. 4 and 5 illustrate details for an outer hub.
Figure 5:
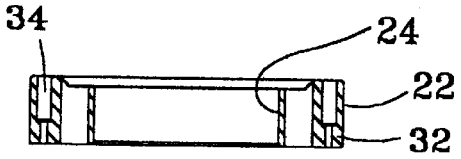

Detail for one embodiment of outer hub 22 is illustrated in FIGS. 4 and 5, wherein threadform 24 is engagable with threadform 19 of inner hub 20 to permit relative movement and engagement therebetween. Outer hub 22 includes a plurality of apertures 32 set in channel 34 for permitting passage of the ends of wire strands 14. In one embodiment of the invention, wire strands 14 pass through apertures 30 in inner hub 20, pass through apertures 32, and are engaged with outer hub 22 as illustrated in FIG. 6. In this embodiment of the invention, rotation of outer hub 22 relative to inner hub 20 increases the longitudinal and angular distance between apertures 30 and 32, thereby lengthening and tensioning each wire strand 14. The tension in wire strands 14 can be increased or decreased by moving outer hub 22 relative to inner hub 20. In another embodiment of the invention, a portion of wire strands 14 can be engaged with inner hub 20 and a portion of wire strands 14 can be engaged with outer hub 22 as illustrated in FIG. 7.

Figure 8:
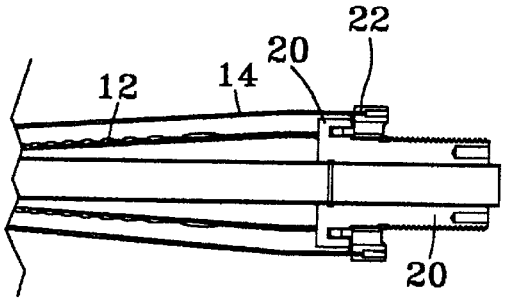
FIG. 8 illustrates apertures for retaining one set of wire strands at a greater radial distance than another set of wire strands.

In another embodiment of the invention as illustrated in FIG. 8, cable 10 can have multiple layers of armor illustrated as wire strand 36 and 38. The ends of wire strand 36 are engaged with inner hub 20, and the ends of wire strands 38 are engaged with outer hub 22. In this embodiment of the invention, relative movement between outer hub 22 and inner hub 20 selectively tension each armor layer by independently tensioning wire strand 36 or 38. Such tensioning movement can be longitudinal, rotational, or a combination of both. The tension in wire strands 36 and in wire strands 38 can be balanced to provide an equal tension, or a dissimilar tension, to accomplish different design objectives.

Figure 9:
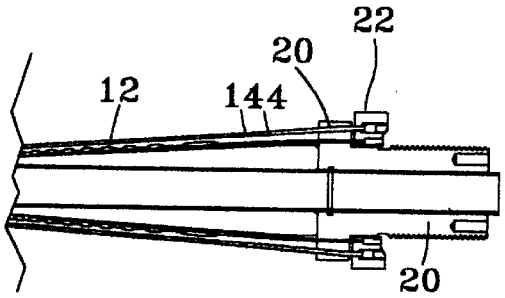
FIG. 9 illustrates apertures within outer hub having differing radial distances from the center of the cable.

As shown in FIG. 8, wire strands 38 are retained by apertures 32 at a radial distance from cable 10 greater than the radial distance held by wire strands 36 due to apertures 30. This orientation provides a structural relationship between wire strands 36, wire strands 38, inner hub 20 and outer hub 22 which significantly strengthens the connection between cable 10 and housing 16. The structural connection can be modified by orienting apertures 32 at a radial distance from the center of cable 10 less than the radial distance of 30, thereby creating a structural connection having different properties based on the orientation of the individual components. In another embodiment of the invention as shown in FIG. 9, outer hub 22 can have apertures located at different radial distances from the center of cable 10 so that the structural connection formed by the components provides different properties and characteristics.

Figure 10:
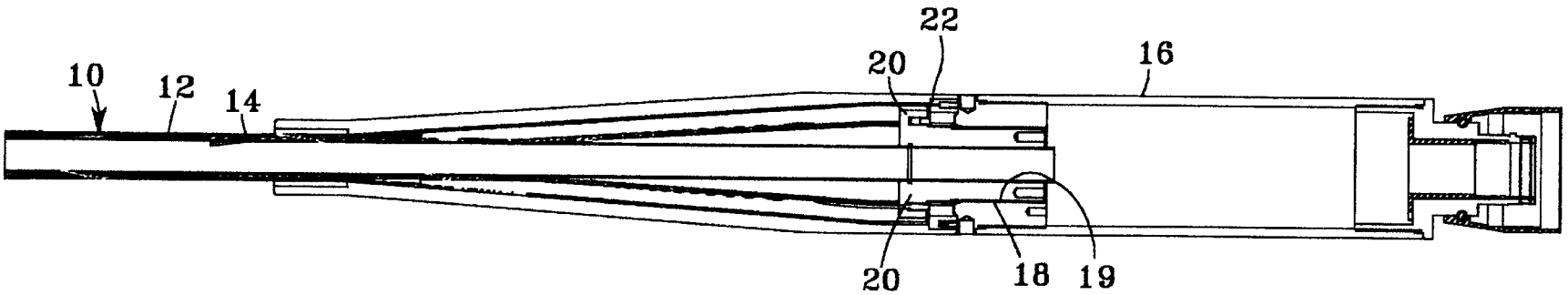
FIG. 10 illustrates an inner hub and outer hub connected to wire strands and to a housing and coupling.

FIG. 10 illustrates another embodiment of the invention wherein housing 16 is connected to cable 10 having multi-strand armor formed with wire strands 36 and 38. Inner insert or sleeve 50 is conically shaped to move armor strands 36 radially outwardly for engagement with apertures 30 within inner hub 20. Outer insert or sleeve 52 is conically shaped to move armor strands 38 radially outwardly for engagement with apertures 32 within outer hub 22. Inserts 52 and 54 increase the cross-section of the wire strands and distance from cable 10 to create a higher moment of inertia and corresponding cable 10 stiffness at the point of connection with housing 16. Outer sleeve 54 can be positioned exterior of wire strands 38 to protect and to lock wire strands in position. Outer hub 22 is attached to inner sleeve 20 and to housing 16 with the threaded connections described above, and the other end of housing 16 can be connected to coupling 56 as illustrated or to another selected device. Seal 58 is positioned between cable 10 and coupling 56 to prevent fluid intrusion A method of the invention is practiced by connecting one end of wire strands 36 to inner hub 20, by connecting one end of wire strands 38 to outer hub 22, and by changing the relative tension in wire strands 36 or 38 by selectively moving outer hub 22 longitudinally or rotationally relative to inner hub 20. Such movement can also be accomplished by moving inner hub 20 or outer hub 22 relative to housing 16 to selectively change the tension within wire strands 36 or 38. Inner hub 20 can be rotated in an opposite direction from rotation of outer hub 22, or can be moved longitudinally relative to housing 16 in a different direction or different amount relative to longitudinal movement of outer hub 22.

Although inner hub 20 and outer hub 22 are illustrated as containing apertures 30 and 32, other structures and configurations can accomplish the same functional benefit provided by the invention. Inner hub 20 and outer hub 22 each have contact points comprising the point of engagement with the ends of the respective wire strands. For example, apertures 30 and 32 can be replaced with grooves or channels open to one side. Apertures, grooves or channels establish the positions of the wire strands relative to the inner or outer hubs. In other embodiments, the contact points or points of engagement can comprise hooks, loops, welded points, locking rings, and other mechanical or structural wire anchors or combinations. Different forms of structural locking devices and configurations can be implemented to retain wire strands 36 and wire strands 38 relative to inner hub 20 and outer hub 22, and to selectively permit tensioning of the wire strands when the initial attachment is made, or subsequently through relative movement between the inner and outer hubs or the housing.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for anchoring a cable having armor formed with multiple wire strands, comprising:

a housing; and a hub attachable to said housing, wherein said hub has a plurality of contact points independently attachable to each wire strand, each contact point engages each wire strand at a selected radial distance from the cable center, and said hub is moveable relative to said housing to selectively tension said wire strands.

2. An apparatus as recited in claim 1, further comprising a plurality of hub apertures proximate to each contact point for permitting the insertion of each wire strand therethrough.

3. An apparatus as recited in claim 1, further comprising a plurality of channels in said hub, wherein each wire strand is insertable within a channel to establish the location of each wire strand relative to said hub.

4. An apparatus as recited in claim 1, wherein said hub has a radially disposed flange, and wherein said plurality of contact points are positioned within a groove in said hub.

5. An apparatus as recited in claim 1, further comprising an insert positioned between the cable and the wire strands for retaining an end of each wire strand at a selected radial distance from the cable.

6. An apparatus as recited in claim 1, further comprising a wire anchor attached to each wire strand for engaging each wire strand to each hub contact point.

7. An apparatus as recited in claim 1, further comprising a second hub having contact points for engagement with certain of the wire strands.

8. An apparatus as recited in claim 7, wherein said second hub is moveable relative to said hub, after the wire strands are engaged with said second hub, for modifying the wire strand tension.

9. An apparatus for anchoring a cable having armor formed with multiple strands, comprising:

a housing;

an inner hub having a plurality of contact points for engaging selected wire strands at a selected radial distance from the cable; and an outer hub attachable to said housing and to said inner hub, wherein said outer hub has a plurality of contact points for independent engagement with selected wire strands, and wherein said outer hub is moveable relative to said inner hub to modify the tension of the sire strands engaged with said outer hub.

10. An apparatus as recited in claim 9, wherein said inner hub is moveable relative to said housing to modify the tension of the wire strands engaged with said inner hub.

11. An apparatus as recited in claim 9, wherein said contact points are located at radial positions exterior of the cable.

12. An apparatus as recited in claim 11, wherein said contact points are located at differing radial positions exterior of the cable.

13. An apparatus as recited in claim 9, further comprising an inner insert for urging the wire strands engaged with said inner hub radially outwardly from the cable, and comprising an outer insert for urging the wire strands engaged with said outer hub radially outwardly from the cable.

14. A method for anchoring a cable having armor formed with multiple wire strands, comprising the steps of:

attaching a housing to the cable;

engaging at least two wire strands with contact points on an inner hub so that each wire strand is independently engagable with said inner hub; and moving said inner hub relative to said housing to modify the tension of the wire strands.

15. A method as recited in claim 14, wherein said inner hub is moved longitudinally relative to said housing to modify the wire strand tension.

16. A method as recited in claim 14, wherein said inner hub is moved rotationally relative to said housing to modify the wire strand tension.

17. A method as recited in claim 14, further comprising the steps of engaging an outer hub between said inner hub and said housing, of engaging at least two wire strands with contact points on said outer hub, and of moving said outer hub relative to said inner hub to modify the tension of the engaged wire strands relative to the tension of wire strands engaged with said inner hub.

18. A method as recited in claim 14, wherein said contact points are located at a position on said inner hub radially outward from the cable.

19. A method as recited in claim 14, further comprising the step of welding the wire strands to said inner hub.

20. A method as recited in claim 14, wherein said engagement between the wire strands and the inner hub is a sliding engagement, further comprising the steps of attaching the wire strands to an outer hub, of positioning the outer hub into engagement between said inner hub and said housing, and of moving said outer hub relative to said inner hub to selectively modify the tension of the wire strands.

* * * * *